United States Patent [19]

Jorzyk et al.

[11] 4,257,870

[45] Mar. 24, 1981

[54] PROCESS FOR THE PURIFICATION OF UNDISTILLABLE SOLID-CONTAINING HYDROCARBON FRACTIONS PRODUCED IN COAL-REFINING

[75] Inventors: Sigurd Jorzyk, Saarbrucken; Helmut Wurfel, Blieskastel, both of Fed. Rep. of Germany

[73] Assignee: Saarbergwerke Aktiengesellschaft, Fed. Rep. of Germany

[21] Appl. No.: 101,351

[22] Filed: Dec. 7, 1979

[30] Foreign Application Priority Data

Dec. 11, 1978 [DE] Fed. Rep. of Germany ..... 2853366

[51] Int. Cl.[3] ..... C10C 3/14

[52] U.S. Cl. ..... 208/39; 208/45

[58] Field of Search ..... 208/39, 45

[56] References Cited

U.S. PATENT DOCUMENTS

| | | | |
|---|---|---|---|
| 2,774,716 | 12/1956 | Kulik | 208/39 |
| 2,956,944 | 10/1960 | Logan et al. | 208/39 |
| 3,197,413 | 7/1965 | Wingerd | 208/39 |
| 3,305,474 | 2/1967 | Knowles et al. | 208/39 |
| 3,434,966 | 3/1969 | Oldenburg | 208/39 |
| 3,885,983 | 5/1975 | Bulit | 208/39 |
| 3,992,281 | 11/1976 | Benade | 208/39 |

*Primary Examiner*—Herbert Levine

*Attorney, Agent, or Firm*—James Creighton Wray

[57] ABSTRACT

Solids are removed from solids-containing undistillable or difficultly distillable liquid hydrocarbon fractions by cooling, solidifying and pulverizing the solids-containing fractions, by contacting the pulverized material with solvent and by separating the solids, then the solvent, resulting in relatively solids-free hydrocarbon fractions.

10 Claims, No Drawings

PROCESS FOR THE PURIFICATION OF UNDISTILLABLE SOLID-CONTAINING HYDROCARBON FRACTIONS PRODUCED IN COAL-REFINING

BACKGROUND OF THE INVENTION

The invention pertains to a process for the separation of solid matter from undistillable liquid hydrocarbon fractions, which, along with other product components, are produced in the refining of coal at high temperatures.

In the refining of coal, for example, its carbonization or liquefaction thru extraction or hydration, various gaseous and liquid hydrocarbons are produced as reaction products. These, insofar as they are distillable, can be separated in one or more distillation steps. As a rule, a hydrocarbon fraction is produced as a distillation residue thereby. This is enriched with the solid particles still contained in the reaction products, such as unchanged coal particles, ash particles, and, in the case of coal liquefaction, necessarily also catalyst particles.

In the case of coal liquifaction, the residue fraction consists essentially of bitumen, while in the case of bituminous coal carbonization, bituminous coal tar asphalt is produced, along with other products, as distillation residue.

In the refined state bituminous coal tar asphalt in particular is suitable as a raw material for the production of a valuable metallurgical coke which is needed in considerable quantities for electrometallurgical purposes.

The separation of solid particles from the liquid hydrocarbon fraction nevertheless caused great difficulties.

Known methods, such as filtration, sedimentation under the force of gravity, or also centrifuging, have not led, it appears, to the desired result.

The mixing of the solid-containing, liquid bitumen fraction produced as an end product of hydration with an aromatic bond containing benzene fraction is already known in the area of coal hydration. Through the mixing of the benzene fraction, it has indeed been possible to improve the filtering capacity of the bitumen, but the efficiency of the solid separation is nonetheless still not satisfactory.

DESCRIPTION OF THE INVENTION

The invention arises from the problem of developing an effective process for the separation of solid matter from heavy, undistillable hydrocarbon fractions.

This problem is solved through the invention, in that the liquid hydrocarbon fraction is solidified by cooling and, in pulverized form, is brought into contact with a solvent, and that first the solid matter and then the solvent are separated out of the solution.

The distinguishing characteristic of this process lies in the fact that the hydrocarbon fraction to be refined is not treated with the solvent in its initial liquid state. Instead, it is solidified by cooling, pulverized, and only then, in a pulverized solid state, is it placed in contact with the solvent.

Instead of being solidified and then ground up, the hydrocarbon fraction to be purified can also be first vaporized and then solidified in droplets so that the fine solids state already is achieved.

It appears, surprisingly enough, that the resultant mixture may now be separated very easily, particularly profitably in centrifuges and cyclones, by the action of centrifugal force. In a bitumen fraction treated according to the process here invented, whose solid matter content before the treatment was about 50%, the remaining solid matter content in the bitumen proved to be only about 0.1%. The technical success obtained can be attributed first of all to the formation, through the solidification and subsequent pulverization of the fraction to be purified, of the now-larger ash particles, such as solid matter agglomerates, which ash particles are compounded from hydrocarbon particles. Through the treatment with the solvent the hydrocarbons are then eliminated from this composite so that a relatively large volume of solid structure remains, which is then easily separated from the solution.

The separation of the undissolved solid matter from the solution is then accomplished, as already mentioned, most efficiently in the centrifuge or cyclone. Other separation methods, such as filtration and sedimentation, are also possible. After separation of the solid matter, the solvent itself is then separated from the now solids-free solution, for example, by vaporization such as by evaporation by ebullition. It may then be recirculated.

The average particle size of the hydrocarbon fraction to be refined is most efficiently set at about 100 to 1000 microns following the completion of its solidification.

As the solvent, any suitable compound as, for example, totuol, benzol, xylol and tetrahydrofuran, may be used.

A particularly advantageous instance of the application of the process here invented lies in the area of coal liquefaction. It is known that in the liquefaction of coal under high pressure and high temperature either through extraction or through hydration, a product fraction is produced that contains bitumen, along with water, unused hydrogen, gaseous hydrocarbons and oil distillate. The dissociation of the product fraction into individual components occurs in several steps, by means of which the bitumen is produced as the bottom product of the last distillation step, together with the solid matter likewise still remaining in the product fraction, such as ash particles, unchanged coal particles and possibly also catalyst particles. This last distillation step is, as a rule, a vacuum distillation step.

In the separation of the solid matter from the bitumen fraction this is solidified by cooling, then pulverized, and finally, preferably after warming, treated with the solvent. The bitumen is thereby extracted from the solid matter, which is specified by the degree of pulverization, and from the ash structure. Next, the remaining solid matter particles and finally the solvent are then separated from the solution, as already described.

It appears that in the case of coal liquefaction an oil distillate fraction produced in the liquefaction process (whose boiling point lies most advantageously about 75° C. and whose end point lies most advantageously about 200° C.) is suitable, in addition to the previously-named solvents.

In the event that the bitumen produced in the process of coal liquefaction is carbonized, an oil distillate fraction obtained in the carbonization can also be used as the solvent.

The separation of the solvent from the solids-free solution of bitumen and solvent is advantageously achieved through vaporization such as evaporation by ebullition. The separated solvent can then be used again.

The quantity of the solvent to be used depends, among other things, on the type of solvent. In the use of oil distillate, it is advantageous to mix about two parts solvent with one part solid matter containing bitumen.

The refined bitumen from the coal liquefaction can be used for the production of heavy heating oil, in which about three parts bitumen are mixed with one part medium or heavy oil, which likewise is obtained as a product of the coal liquefaction. The addition of the middle or heavy oil happens efficiently before or during the separation of the solvent from the solution.

The now solid matter-free bitumen can, however, be subjected also to a further distillation, in which the residual oil distillate still contained in the bitumen is obtained. This residual oil distillate could not be separated in the distillation step superposed on the solid matter separation because of the solid matter content.

The process mode according to the invention for solid matter separation from the hydration residue thus makes possible the nearly complete extraction of the valuable oil distillate produced in the coal hydration.

A further favorable instance of the application of the process according to the invention lies in the refining of bituminous coal tar asphalt, which is produced as a by-product of the purification of carbonized products from the carbonization of bituminous coal. It has been shown that the otherwise low value carbonization by-product, bituminous coal tar asphalt, can, in the refined state, be carbonized to valuable metallurgical coke, which is necessary for the production of electrodes for electrometallurgical purposes.

A further very remarkable advantage of the process according to the invention lies in that the hydrocarbon fraction to be purified can be interstratified before the purification step by a simple method, so that the refining need not occur directly in connection with the production.

While the invention has been described with reference to specific embodiments, modifications and variations may be accomplished without departing from the scope of the invention, as defined in the following claims.

We claim:

1. Process for the separation of solids from solids-containing undistillable liquid hydrocarbon fractions which are produced, along with other product components, in the refining of coal under high temperatures, characterized in that the liquid hydrocarbon fractions are solidified by cooling, and in a pulverized form are brought into contact with a solvent and that first the solid matter and then the solvent are separated from the solution.

2. Process according to claim 1, characterized in that the liquid hydrocarbon fraction is atomized and the droplets that form are solidified by cooling.

3. Process according to claim 1 wherein the separation of the solvent from the solution occurs by vaporization.

4. Process according to claims 1, 2 or 3, wherein the solidified hydrocarbon fraction is pulverized to an average particle size of about 100 to 1000 microns.

5. Process according to claims 1, 2 or 3 wherein a bituminous fraction is treated as the solids-containing undistillable hydrocarbon fraction, the bituminous fraction being produced as a solids-containing reaction product from the separation of water, gas and oil distillate in the liquefaction of coal.

6. Process according to claims 1, 2 or 3 wherein a carbon-rich oil distillate fraction is used as a solvent.

7. Process according to claim 6 wherein an oil distillate fraction separated from the reaction mixture produced in coal liquefaction is used as a solvent.

8. Process according to claim 6 wherein the oil distillate fracition exhibits a boiling point of about 75° C. and an end point of about 200° C.

9. Process according to claim 1 wherein solids-free bitumen being produced is used, at least in part, for the production of heavy heating oil, in doing which about three parts bitumen are mixed with one part medium and/or heavy oil, which likewise is produced in the coal liquefaction.

10. Process according to claim 9 wherein the medium and/or heavy oil is added before or during the separation of the solvent from the solution of bitumen and solvent.

* * * * *